US008054234B2

(12) United States Patent
Huang et al.

(10) Patent No.: US 8,054,234 B2
(45) Date of Patent: Nov. 8, 2011

(54) MULTIBAND SATELLITE ANTENNA

(75) Inventors: Chang-Hsiu Huang, Taipei (TW); Chung-Min Lai, Taipei (TW)

(73) Assignee: Wistron NeWeb Corp., Taipei (TW)

( * ) Notice: Subject to any disclaimer, the term of this patent is extended or adjusted under 35 U.S.C. 154(b) by 401 days.

(21) Appl. No.: 12/436,612

(22) Filed: May 6, 2009

(65) Prior Publication Data

US 2010/0060536 A1 Mar. 11, 2010

(30) Foreign Application Priority Data

Sep. 10, 2008 (TW) ..... 97134700 A

(51) Int. Cl.
*H01Q 13/00* (2006.01)

(52) U.S. Cl. ..... 343/786; 343/772; 333/21 A

(58) Field of Classification Search ..... 343/771, 343/772, 786; 333/21 A, 135
See application file for complete search history.

(56) References Cited

U.S. PATENT DOCUMENTS

| | | | | | |
|---|---|---|---|---|---|
| 4,675,689 | A * | 6/1987 | Haas et al. | ..... | 343/786 |
| 5,374,938 | A * | 12/1994 | Hatazawa et al. | ..... | 343/756 |
| 5,434,585 | A * | 7/1995 | Harris | ..... | 343/786 |
| 5,552,797 | A * | 9/1996 | Cook | ..... | 343/786 |
| 6,052,099 | A * | 4/2000 | Imaizumi et al. | ..... | 343/840 |

* cited by examiner

*Primary Examiner* — Tho G Phan
(74) *Attorney, Agent, or Firm* — Muncy, Geissler, Olds & Lowe, PLLC

(57) ABSTRACT

A multiband satellite antenna is provided. The multiband satellite antenna includes a plurality of first band wave receivers and a second band wave receiver. The first band wave receiver includes a first band wave guide, and the second band wave receiver has a first receiving unit and a second receiving unit. The first receiving unit and the second receiving unit are disposed on opposite sides of an alignment line of the first band wave receivers. Each of the first receiving unit and the second receiving unit has a second band wave guide. Output ends of the first receiving unit and the second receiving unit are coupled together to combine signals received from both units into a single signal, and then the single signal is outputted as a second frequency signal. Through this design, in a high satellite density environment, dual-frequency signals from several satellites at similar elevation angles can be received by the antenna of the invention.

20 Claims, 9 Drawing Sheets

MULTIBAND SATELLITE ANTENNA

This application claims priority based on a Taiwanese patent application No. 097134700, filed on Sep. 10, 2008, the disclosure of which is incorporated herein by reference in its entirety.

BACKGROUND OF THE INVENTION

1. Field of the Invention

The present invention relates to a multiband satellite antenna; more particularly, the present invention relates to a multiband satellite antenna for receiving satellite signals.

2. Description of the Related Art

Recently, as the space technology advances, the applications of satellite bring more and more convenience into people's life. Satellites are widely applied in various technologies including, for example, explorations, weather forecasting, or global positioning, etc., and especially mature in signal transmissions. Satellites are used as a transmitting medium for signal transmissions in communication, data transmission, or video/audio broadcasting fields. However, as the demand of applying satellites to signal transmissions grows, the number of satellites and the available frequency bands should be increased accordingly.

In general, the common frequency bands for satellite communications include Ku frequency bands and Ka frequency bands. The Ka frequency band has a higher frequency and is less affected by terrestrial microwaves but seriously affected by rainfalls. The Ku frequency band has a lower frequency and is more affected by terrestrial microwaves but less affected by rainfalls. Current satellites include a wideband satellite, which can transmit signals of the two frequency bands simultaneously, and therefore, a corresponding antenna should have the ability to receive signals of the two frequency bands simultaneously. As shown in FIG. 1A, a traditional dual-frequency satellite antenna includes a wave receiving device 5, which has a Ka band wave guide 10 and a Ku band wave guide 20 disposed coaxially. The Ku band wave guide 20 has a larger inner diameter and surrounds the Ka band wave guide 10. A high frequency suppression module 30 is disposed outside the Ku band wave guide 20 for suppressing the high level mode in electric fields, so that the field pattern produced by the wave receiving device 5 can be smoother and more symmetrical. However, since the Ku band wave guide 20 is disposed coaxial with the Ka band wave guide 10, the inner diameter of Ku band wave guide 20 should be increased to correspond to the Ku frequency band. Therefore, the wave receiving device 5 has a larger volume according to this design.

In addition, taking geosynchronous satellites as an example, because the number of satellites keeps increasing while orbit positions are limited (360 degrees), consequently, the International Telecommunication Union (ITU) have changed the satellite distribution from every 3 degrees to every 2 degrees for one satellite. Due to the decrease in the included angle between satellites, the wave receiving device needs to be adjusted accordingly. FIG. 1B illustrates a traditional wave receiving device 7 capable of receiving signals from several satellites simultaneously. The wave receiving device 7 includes a Ku band wave guide 20 in the middle and Ka band wave guides 10 on two sides. In such a design, the satellite signals received at a same elevation angle are single frequency signals, and therefore, the wave receiving device 7 is not applicable to dual frequency satellite signals. Furthermore, in such a design, the space between the two Ka band wave guides 10 is limited, and therefore, only one Ku band wave guide 20 can be accommodated therein. Additionally, because the space between the two Ka band wave guides 10 is limited, the wave receiving device 5 of FIG. 1A cannot be disposed therein.

SUMMARY OF THE INVENTION

It is an objective of the present invention to provide a multiband satellite antenna for receiving signals from multiple satellites at similar elevation angles.

It is another objective of the present invention to provide a multiband satellite antenna for receiving dual-frequency signals from satellites at a same elevation angle.

It is yet another objective of the present invention to provide a multiband satellite antenna with a wave receiver for receiving dual-frequency signals disposed among neighboring satellite wave receivers.

The multiband satellite antenna includes a plurality of first band wave receivers and a second band wave receiver. The first band wave receiver includes a first band wave guide, and the second band wave receiver has a first receiving unit and a second receiving unit. The first receiving unit and the second receiving unit are respectively disposed on opposite sides of an alignment line of the plurality of first band wave receivers. Hence, the second band wave receiver and the first band wave receivers are disposed non-coaxially. Each of the first receiving unit and the second receiving unit has a second band wave guide. The second band wave guide is disposed parallel to the above-mentioned first band wave guide and side by side. Output ends of the first receiving unit and the second receiving unit are coupled together to combine the signals received by both units into a single signal, and then the single signal is outputted as a second frequency signal.

Since the first receiving unit, the second receiving unit, and the first band wave receivers are disposed non-coaxially, the spatial variability of the antenna can be increased. In a high satellite density environment, with such a design, dual frequency signals from several satellites at similar elevation angles can be received by a same antenna in accordance with the invention.

DETAILED DESCRIPTION OF THE PREFERRED EMBODIMENT

The invention provides a multiband satellite antenna. In an embodiment, the multiband satellite antenna of the invention is a satellite signal receiving device for receiving satellite signals. When a plurality of satellites of same or different frequency at the same or almost the same elevation angle are involved, the multiband satellite antenna of the invention can provide a better effect upon receiving signals.

Figure 1A:
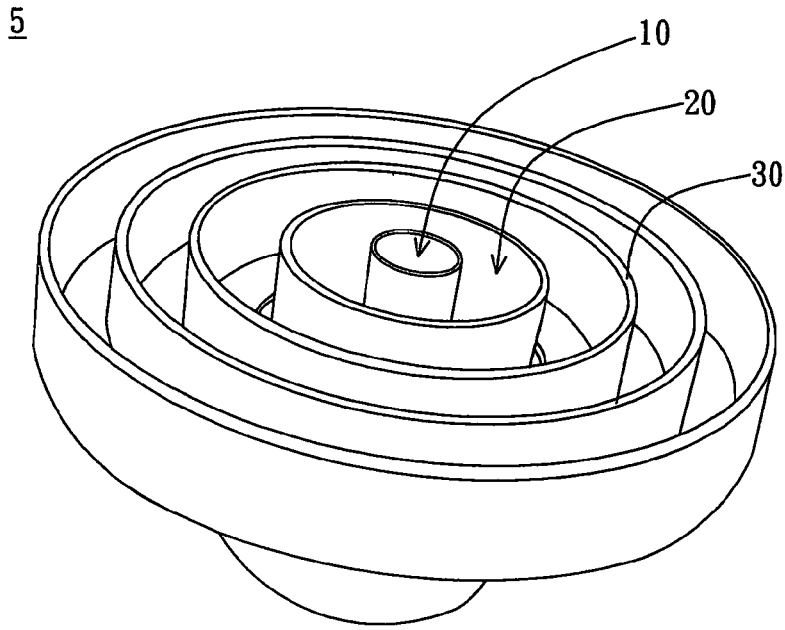
FIG. 1A (PRIOR ART)
FIG. 1A illustrates a schematic view of a traditional dual-frequency receivers for receiving satellite signals.
Figure 1B:
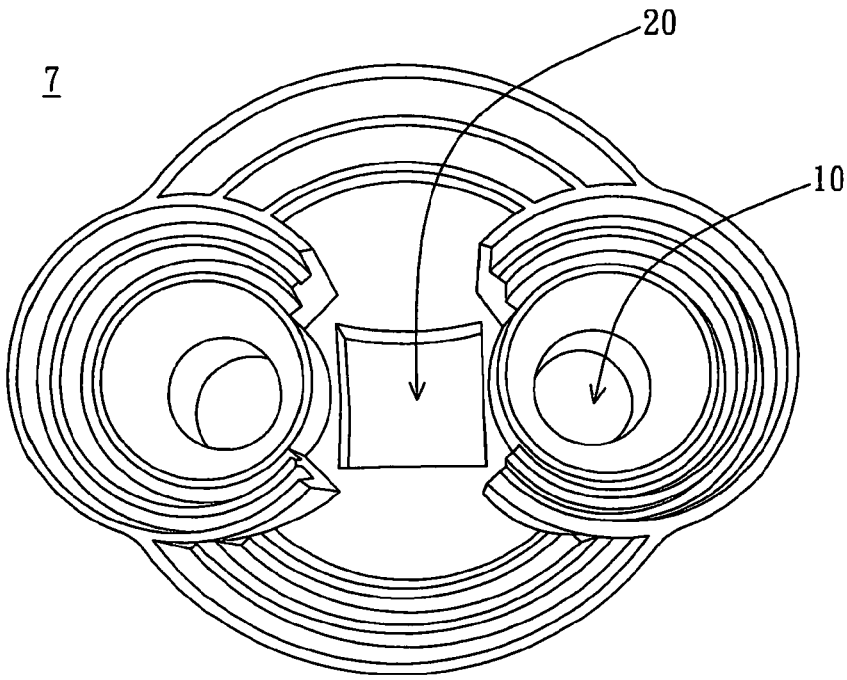
FIG. 1B (PRIOR ART)
FIG. 1B illustrates a schematic view of a traditional receiver for receiving satellite signals.
Figure 2:
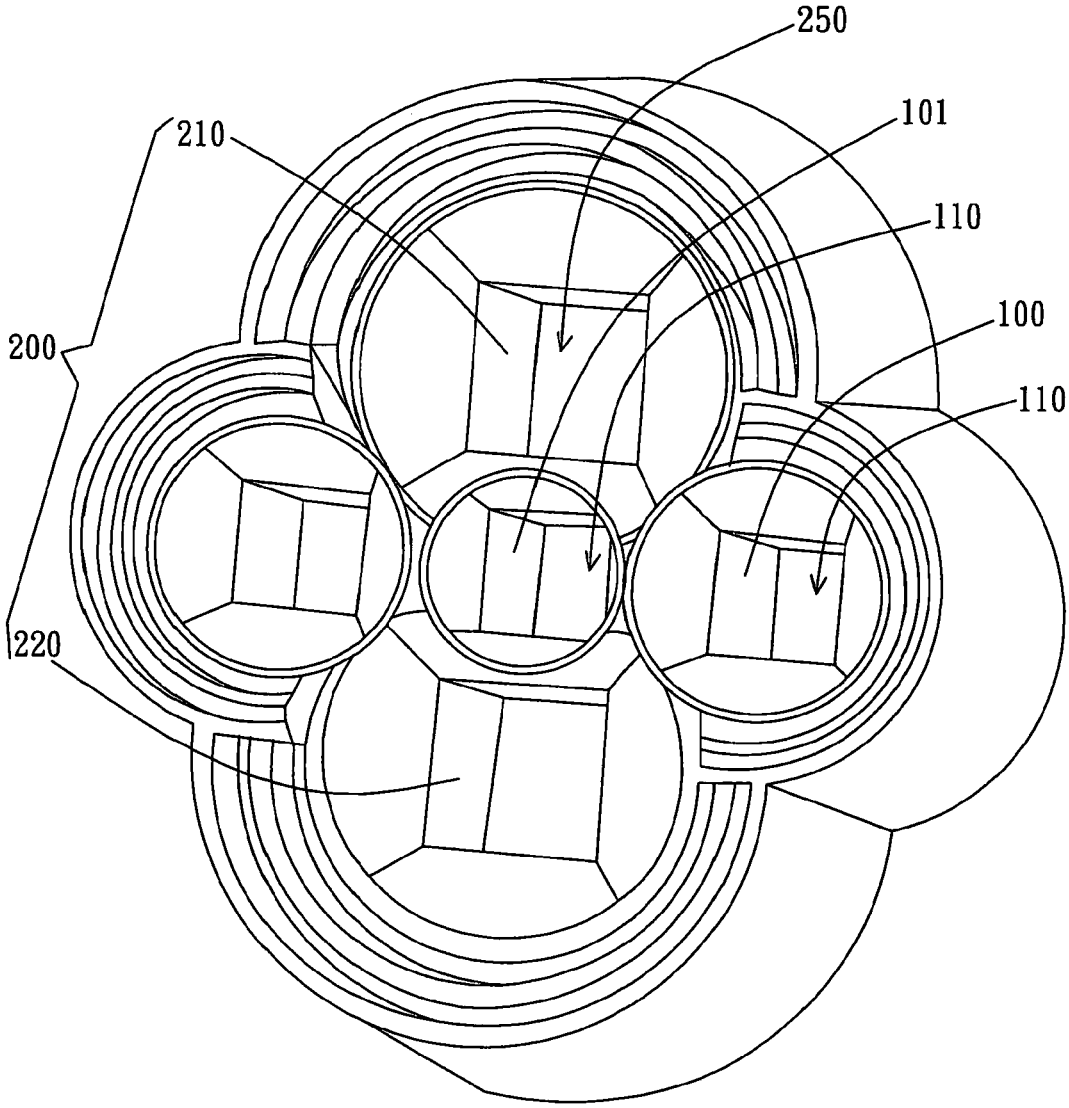
FIG. 2 illustrates a schematic view of a multiband satellite antenna in accordance with an embodiment of the invention.

As shown in FIG. 2, the multiband satellite antenna includes a plurality of first band wave receivers 100 and a second band wave receiver 200. Each of the first band wave receivers 100 has a first band wave guide 110. In this embodiment, the first band wave guide 110 is formed in a central part of the first band wave receiver 100. The first band wave guide 110 preferably has a square cross-section, that is, the first band wave guide 110 is formed as a square column with a hollow space. However, in other embodiments, the first band wave guide 110 can have a round cross-section. Furthermore, the plurality of first band wave receivers 100 are arranged in a line. In the embodiment shown in FIG. 2, three sets of the first band wave receiver 100 are shown. The first band wave guide 110 of each first band wave receiver 100 is parallel to each other. The first band wave guide 110 of each first band wave receiver 100 is disposed along a straight line in a form similar to a pan flute. In order to receive satellite signals effectively, the first band wave receiver 100 is preferably provided with a polarized piece and a receiving probe (not shown) formed at the rear end of the first band wave receiver 100. Each of the first band wave receivers 100 independently receives signals, and its rear end also independently outputs the received signal as a first frequency band signal.

As shown in FIG. 2, the second band wave receiver 200 includes a first receiving unit 210 and a second receiving unit 220. The first receiving unit 210 and the second receiving unit 220 are respectively disposed on two opposite sides of an alignment line of the plurality of first band wave receivers 100. In other words, the first receiving unit 210 and the second receiving unit 220 are disposed in a direction across the alignment direction of the first band wave receivers 100. The first receiving unit 210 and the second receiving unit 220 are separated at two sides of the first band wave receivers 100. Hence, the second band wave receiver 200 and the first band wave receivers 100 are disposed in a non-coaxial arrangement. In an embodiment, as shown in FIG. 2, one of the first band wave receivers 100 is a central first band wave receiver 101 located at the central location among the first band wave receivers 100. The first receiving unit 210 and the second receiving unit 220 are respectively disposed on two opposite sides of the central first band wave receiver 101. Moreover, the first receiving unit 210, the central first band wave receiver 101, and the second receiving unit 220 are arranged in a direction orthogonal to the direction that the first band wave receivers 100 are arranged.

Each of the first receiving unit 210 and the second receiving unit 220 includes a second band wave guide 250. The second band wave guide 250 is disposed parallel to the first band wave guide 110 and side by side. In the embodiment, the first band wave receiver 100 is a high frequency wave receiver and preferably receives, for example, Ka frequency signals, but is not limited thereto. The second band wave receiver 200 is a low frequency wave receiver and preferably receives, for example, Ku frequency signals, but is not limited thereto. Therefore, an inner diameter of the second band wave guide 250 is preferably larger than an inner diameter of the first band wave guide 110. In order to receive satellite signals effectively, the first receiving unit 210 and the second receiving unit 220 are preferably provided with a polarized piece and a receiving probe (not shown) at the rear end of the second band wave guide 250. The signal outputting rear ends of the first receiving unit 210 and the second receiving unit 220 are coupled with each other. Therefore, the signals received by the first receiving unit 210 and the signals received by the second receiving unit 220 are combined into a single signal, and then the single signal is outputted as a second frequency signal. In other words, the second band wave receiver 200 is divided into two portions for receiving signals respectively, and then the received signals are combined into a single signal. Since the first receiving unit 210 and the second receiving unit 220 are disposed non-coaxial with the first band wave receiver 100, the spatial variability of the antenna can be increased.

Figure 3:
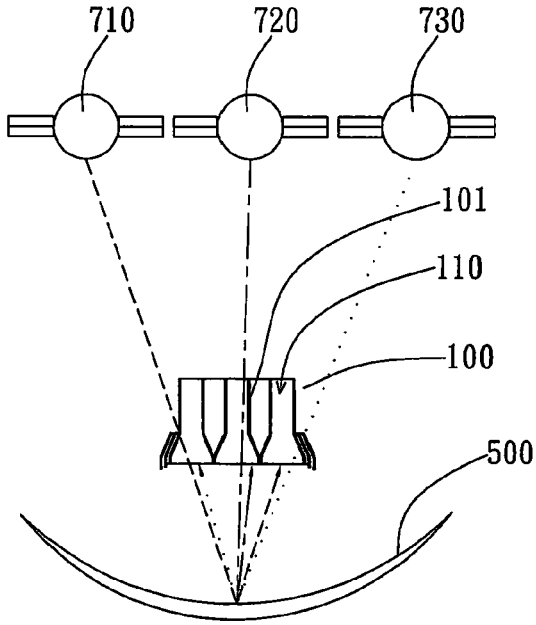
FIG. 3 illustrates a schematic view of a multiband satellite antenna for receiving signals from a plurality of satellites in accordance with an embodiment of the invention.
Figure 4:
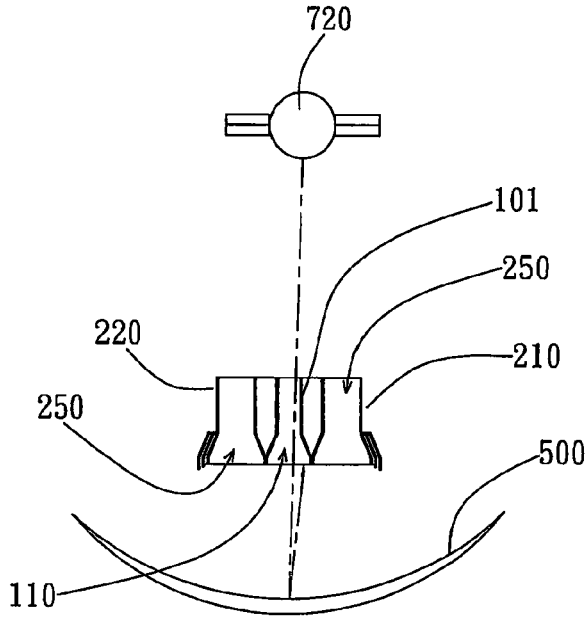
FIG. 4 illustrates a schematic view of a multiband satellite antenna for receiving dual-frequency signals in accordance with an embodiment of the invention.

As shown in FIG. 3 and FIG. 4, the multiband satellite antenna further includes a disc surface 500. The first band wave receiver 100 and the second band wave receiver 200 are both disposed facing the disc surface 500. FIG. 3 is a cross-sectional schematic view cut along the alignment direction of the plurality of first band wave receivers 100. As shown in FIG. 3, a first satellite 710, a second satellite 720, and a third satellite 730 are distributed in outer space, and the plurality of first band wave receivers 100 respectively receive the signals transmitted from the first satellite 710, the second satellite 720, and the third satellite 730 and reflected by the disc surface 500. Because the satellite density in outer space is growing as time passing by, the difference in elevation angle of the first satellite 710, the second satellite 720, and the third satellite 730 with respect to the multiband satellite antenna may be within 2 degrees. For example, the first satellite 710, the second satellite 720, and the third satellite 730 are disposed at 99.2 degrees West Longitude, 101 degrees West Longitude, and 102.8 degrees West Longitude respectively. After the signals from the first satellite 710, the second satellite 720, and the third satellite 730 are reflected by the disc surface 500, the signals respectively enter the corresponding first band wave receiver 100. After the signals are transmitted and polarized within the first band wave guide 110, the signals are introduced to a low-noise down-conversion amplifier through a receiving probe. After processed by the low-noise down-conversion amplifier, the signals are outputted to a demodulator to be demodulated and then transmitted.

FIG. 4 illustrates a cross-sectional view along the alignment direction of the first receiving unit 210 and the second receiving unit 220. As shown in FIG. 4, the first receiving unit 210 and the second receiving unit 220 are disposed side by side with the central first band wave receiver 101 therebetween, and hence can receive signals from the second satellite 720 which is located at the same elevation angle. The second satellite 720 can transmit dual-frequency signals, such as Ka frequency signals and Ku frequency signals, and therefore, the transmission channels can be increased without increasing the satellite density. Besides, if the second satellite 720 only transmits single frequency signals, another satellite can be disposed at the same elevation angle as the second satellite 720 to transmit signals of different frequency domains.

In this embodiment, the central first band wave receiver 101 receives Ka frequency signals, and the first receiving unit 210 and the second receiving unit 220 respectively receive Ku frequency signals. After reflected by the disc surface 500, the Ku frequency signals respectively enter the first receiving unit 210 and the second receiving unit 220. After transmitted and polarized within the second band wave guide 250, the signals are introduced to a low-noise down-conversion amplifier through a receiving probe. After processed by the low-noise down-conversion amplifier, the signals are outputted to a demodulator to be demodulated and then transmitted. In one embodiment, signals received by the first receiving unit 210 and the second receiving unit 220 are preferably combined before introduced to the low-noise down-conversion amplifier. In other embodiments, signals received by the first receiving unit 210 and the second receiving unit 220 are combined after processed by low-noise down-conversion amplifier. In a high satellite density environment, signals transmitted from several dual-frequency satellites at almost a same elevation angle can be received by the antenna designed in accordance with the above embodiments of the invention.

Figure 5A:
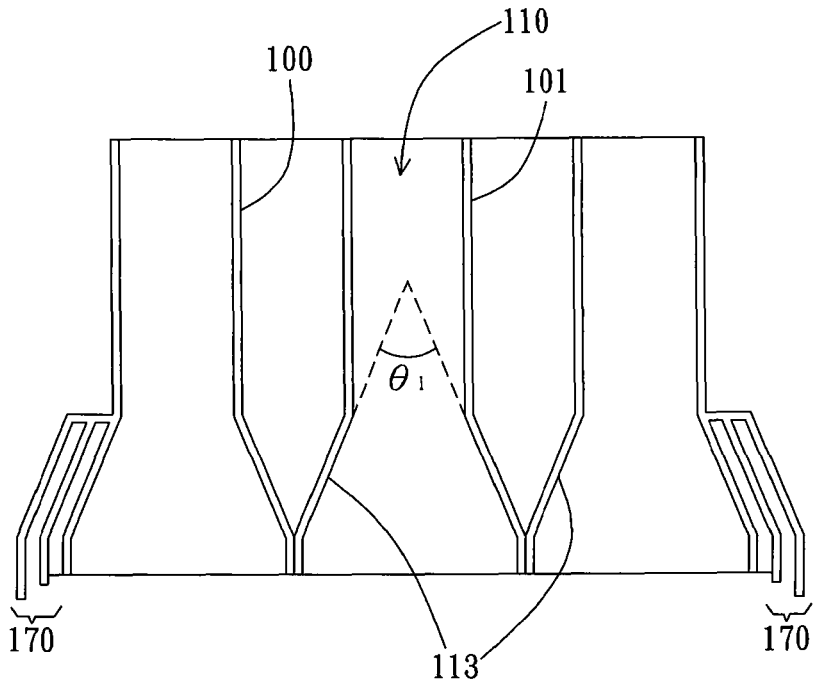
FIG. 5A illustrates a cross-sectional view of a multiband satellite antenna in accordance with an embodiment of the invention.
Figure 5B:
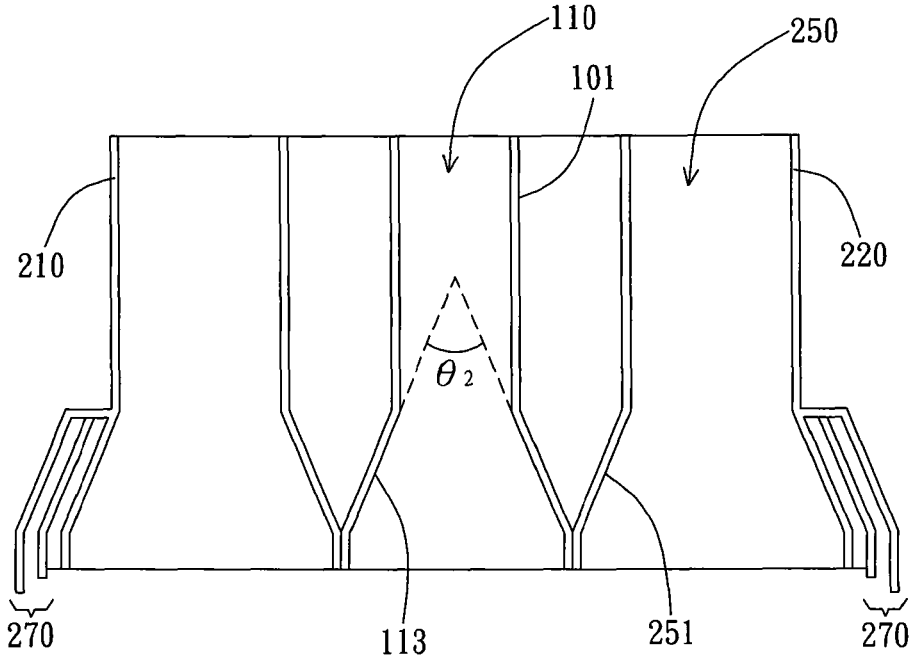
FIG. 5B illustrates a cross-sectional view of the embodiment in FIG. 5A from another angle.

As shown in FIG. 5A, one end of the first band wave guide 110 for receiving signals is formed as a horn portion 113. The horn portion 113 opens outward with an opening angle θ1. Preferably, the opening angle θ1 is between 65 degrees to 70 degrees. Similarly, as shown in FIG. 5B, one end of the second band wave guide 250 for receiving signals is formed as a horn portion 251. The horn portion 251 opens outward with an opening angle θ2. Preferably, the opening angle θ2 is between 65 degrees to 70 degrees.

Figure 6:
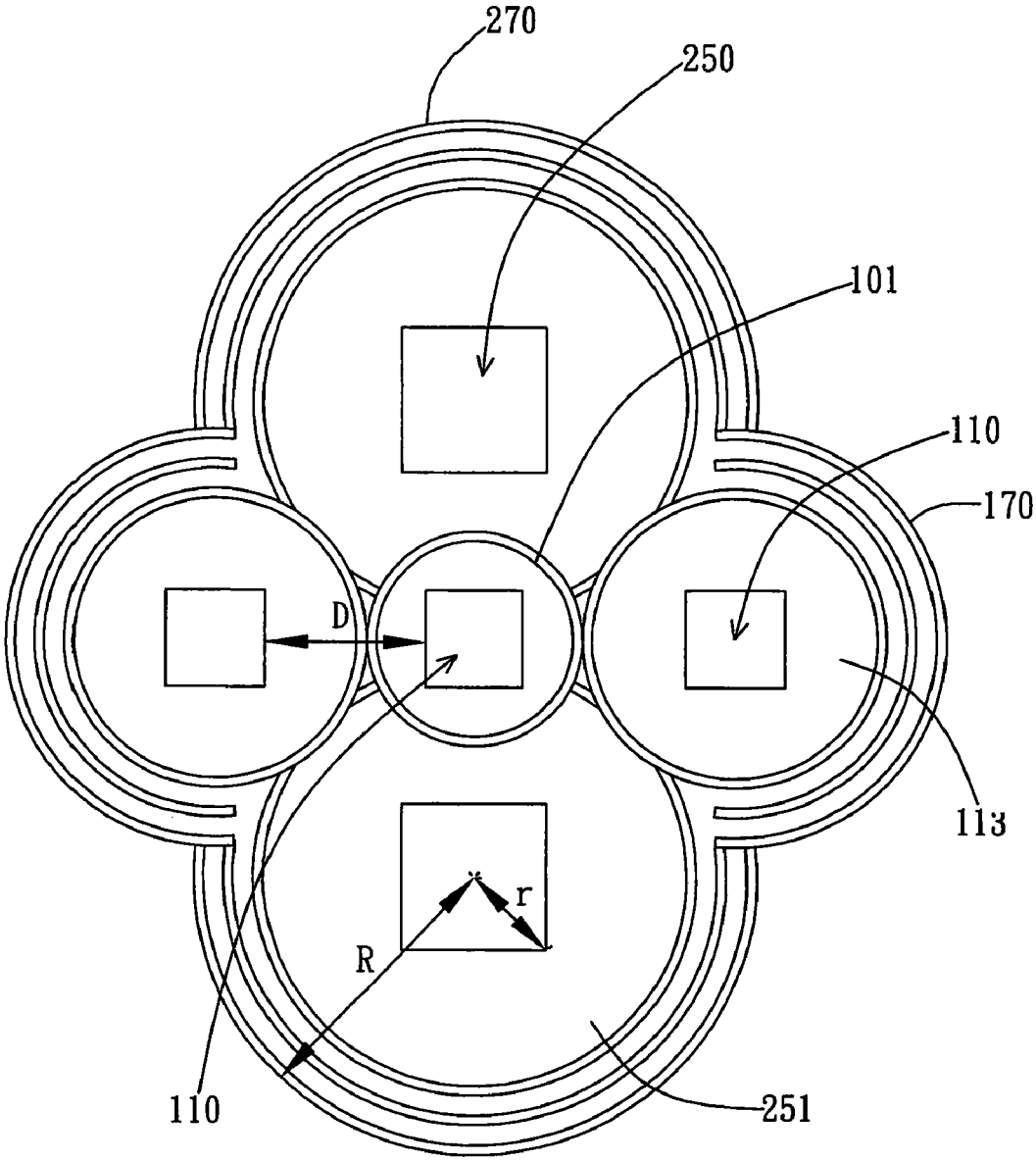
FIG. 6 illustrates a top view of the embodiment in FIG. 2.

As shown in FIG. 5A, FIG. 5B, and FIG. 6, the first band wave receiver 100 includes a high frequency suppression module 170 which is formed on the outer edge of the signal receiving end of the first band wave guide 110. In this embodiment, the high frequency suppression module 170 is composed of several curved walls. These curved walls have heights increased progressively from inside to outside and coaxially surround the first band wave guide 110. Two ends of each curved wall respectively connect to outer walls of the first receiving unit 210 and the second receiving unit 220. However, in other embodiments, the high frequency suppression module 170 may be formed in a closed ring shape surrounding the first band wave guide 110. Similarly, the first receiving unit 210 and the second receiving unit 220 also respectively have a high frequency suppression module 270 which is formed on an outer edge of the signal receiving end of the second band wave guide 250. The high frequency suppression module 270 is composed of several curved walls. These curved walls preferably have heights increased progressively from inside to outside and coaxially surround the second band wave guide 250. In other embodiments, these curved walls can have a same height. Furthermore, two ends of each curved wall are connected to different first band wave receivers 100 to enclose the second band wave guide 250 therein. Through this design, the high level mode in electric field can be limited and changed, so that the field patterns generated by the first band wave receiver 100 and the second band wave receiver 200 can be smoother and more symmetric or adjusted according to different design needs.

In the embodiment shown in FIG. 6, the distance between the outer edges of the neighboring first band wave guides 110 is smaller than the respective radius of the first receiving unit 210 and the second receiving unit 220. As shown in FIG. 6, the first band wave guide 110 of the central first band wave receiver 101 and the outer edge of the first band wave guide 110 of the neighboring first band wave receiver 100 are spaced by a distance D, which is smaller than the radius R of the first receiving unit 210 or the second receiving unit 220. In this embodiment, the radius R of the first receiving unit 210 or the second receiving unit 220 includes the thickness of the horn portion 251 and the thickness of the high frequency suppression module 270. However, in another embodiment, the distance between the outer edges of the neighboring first band wave guides 110 can be even smaller than the radius r of the second band wave guide 250. Furthermore, when the difference in the elevation angle of satellites is about 2 degrees, according to reflecting surface parameters of an exemplary embodiment, the distance between the centers of the neighboring first band wave guides 110 is about 18.8 mm.

Figure 7A:
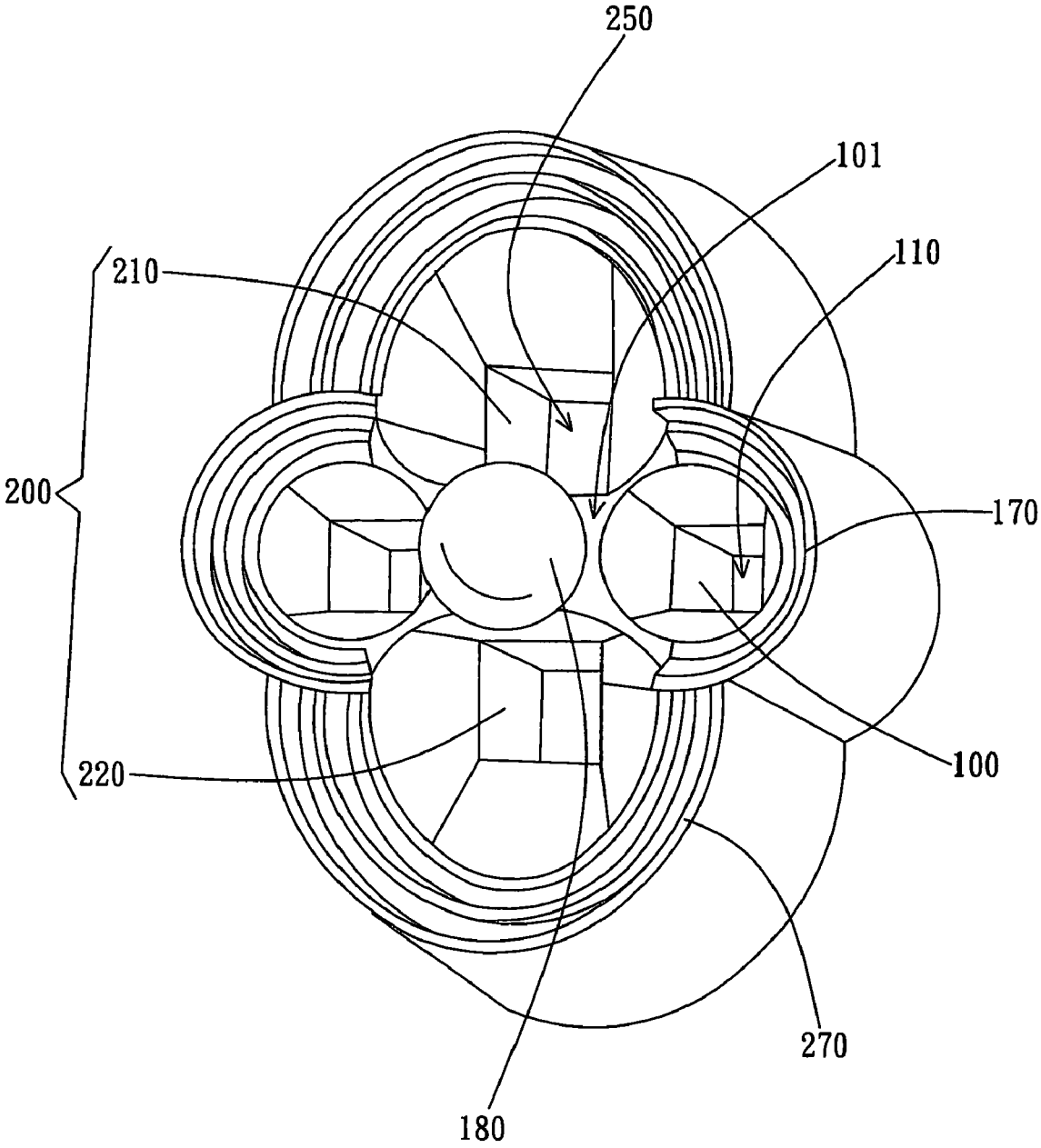
FIG. 7A to FIG. 7D illustrate schematic views of a multiband satellite antenna using a wave receiving block.
Figure 7B:
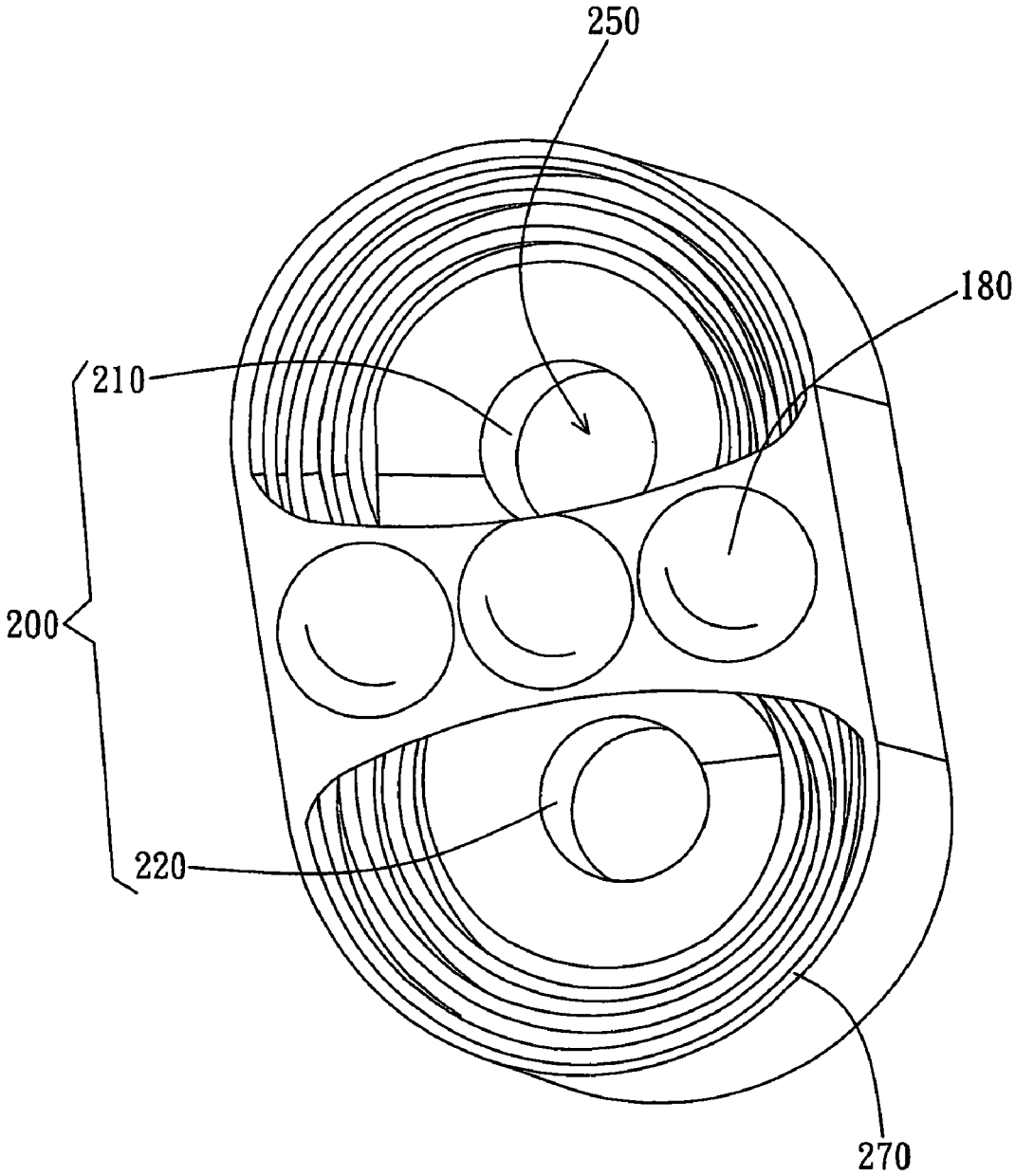

In the embodiment shown in FIG. 7A, the first band wave receiver 100 can include a wave receiving block 180 which is disposed at the signal receiving end of the first band wave guide 110. In this embodiment, the wave receiving block 180 is designed as a sphere. By implementing the wave receiving block 180, the horn portion 113 or the high frequency suppression module 170 can be omitted and the space occupied can be saved. As shown in FIG. 7A, because the central first band wave receiver 101 is disposed between two first band wave guides 110, the usable space of the central first band wave receiver 101 is relatively small. Hence, the wave receiving block 180 is used in the central first band wave receiver 101 together with the first band wave guide 110 for space saving. However, in other embodiments, as shown in FIG. 7B, all three first band wave receivers 100 utilize the wave receiving blocks 180 together with the first band wave guides 110.

Figure 7C:
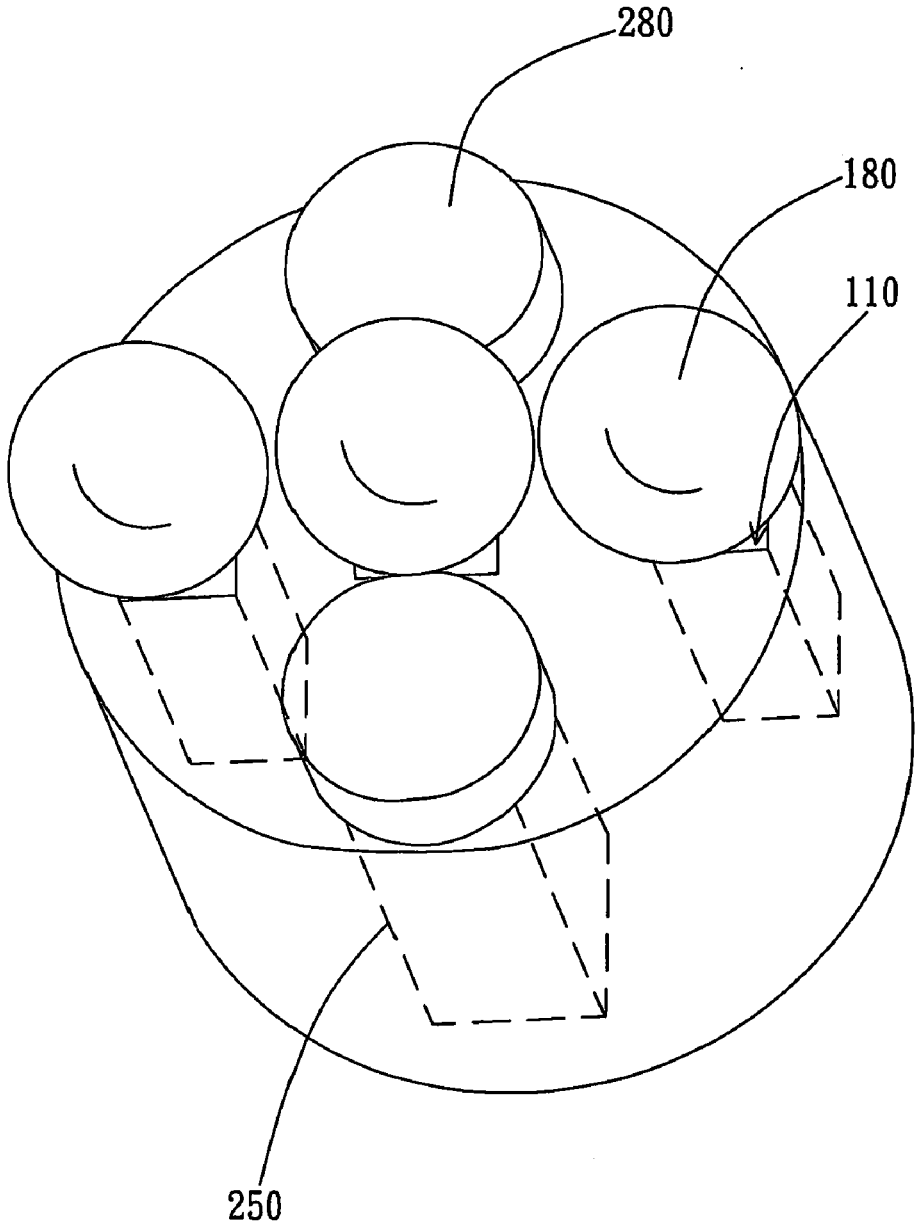
Figure 7D:
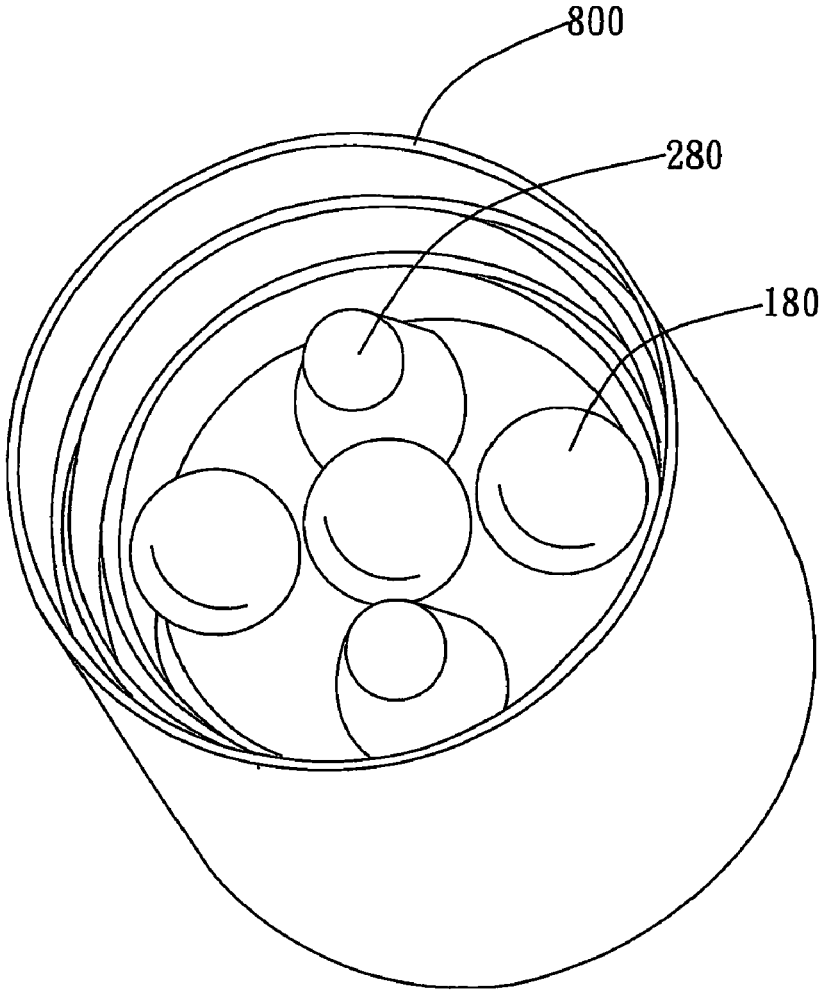

In the embodiment shown in FIG. 7C, each of the first receiving unit 210 and the second receiving unit 220 includes a wave receiving block 280 disposed on the second band wave guide 250. In this embodiment, the wave receiving block 280 disposed on the second band wave guide 250 is in a shape of a cylinder. By implementing the wave receiving block 280, the horn portion 251 or the high frequency suppression module 270 can be omitted and the space occupied can be saved. However, in other embodiments, as shown in FIG. 7D, a high frequency suppression module 800 can be employed. In this embodiment, the high frequency suppression module 800 includes at least one closed ring wall and surrounds the first band wave receivers 100 and the second band wave receivers 200. When the high frequency suppression module 800 includes a plurality of closed ring walls, the wall heights are preferably increased progressively from inside to outside, so as to produce a smoother and more symmetric field pattern.

Although the present invention has been described through the above-mentioned related embodiments, the above-mentioned embodiments are merely the examples for practicing the present invention. What need to be indicated is that the disclosed embodiments are not intended to limit the scope of the present invention. On the contrary, the modifications within the essence and the scope of the claims and their equivalent dispositions are all contained in the scope of the present invention.

What is claimed is:

1. A multiband satellite antenna, comprising:

a plurality of first band wave receivers, each of said first band wave receivers including a first band wave guide, wherein said plurality of first band wave receivers are arranged in a line; and a second band wave receiver including a first receiving unit and a second receiving unit, each of said first receiving unit and said second receiving unit including a second band wave guide, wherein said first receiving unit and said second receiving unit are disposed on opposite sides of an alignment line of said plurality of first band wave receivers respectively and separated by said plurality of first band wave receivers, signals received by said first receiving unit and said second receiving unit are combined to form a single signal.

2. The multiband satellite antenna of claim 1, wherein an inner diameter of said first band wave guide is smaller than an inner diameter of said second band wave guide.

3. The multiband satellite antenna of claim 1, wherein a distance between outer edges of two neighboring first wave guides is smaller than an inner diameter of said first receiving unit and an inner diameter of said second receiving unit.

4. The multiband satellite antenna of claim 3, wherein a distance between outer edges of two neighboring first band wave receivers is smaller than a radius of said second band wave guide.

5. The multiband satellite antenna of claim 1, wherein a distance between centers of two neighboring first band wave guides is about 18.8 mm.

6. The multiband satellite antenna of claim 1, wherein one end of said first band wave guide is formed as a horn portion, and said horn portion has an opening angle.

7. The multiband satellite antenna of claim 6, wherein said opening angle is between 65 degrees and 70 degrees.

8. The multiband satellite antenna of claim 1, wherein said first band wave receiver includes a high frequency suppression module, and said high frequency suppression module is formed on an outer edge of one end of said first band wave guide.

9. The multiband satellite antenna of claim 8, wherein said high frequency suppression module includes at least a curved wall surrounding said first band wave guide, and two ends of said curved wall are connected to said first receiving unit and said second receiving unit respectively.

10. The multiband satellite antenna of claim 1, wherein one end of said second band wave guide is formed as a horn portion, and said horn portion has an opening angle.

11. The multiband satellite antenna of claim 10, wherein said opening angle is between 65 degrees and 70 degrees.

12. The multiband satellite antenna of claim 1, wherein each of said first receiving unit and said second receiving unit includes a high frequency suppression module, and said high frequency suppression module is formed on an outer edge of one end of said second band wave guide.

13. The multiband satellite antenna of claim 12, wherein said high frequency suppression module includes at least a curved wall surrounding said second band wave guide, and two ends of said curved wall are respectively connected to different said first band wave receivers.

14. The multiband satellite antenna of claim 1, wherein one of said plurality of first band wave receivers is a central first band wave receiver, said first receiving unit and said second receiving unit are disposed on opposite sides of said central first band wave receiver respectively, and an alignment direction of said first receiving unit, said central first band wave receiver, and said second receiving unit is orthogonal to an alignment direction of said plurality of first band wave receivers.

15. The multiband satellite antenna of claim 1, further comprising a high frequency suppression module surrounding said plurality of first band wave receivers and said second band wave receiver.

16. The multiband satellite antenna of claim 15, wherein said high frequency suppression module includes at least a closed ring wall.

17. The multiband satellite antenna of claim 1, wherein said first band wave receiver includes a wave receiving block disposed on said first band wave guide.

18. The multiband satellite antenna of claim 17, wherein said wave receiving block is formed as a sphere.

19. The multiband satellite antenna of claim 1, wherein each of said first receiving unit and said second receiving unit includes a wave receiving block disposed on said second band wave guide.

20. The multiband satellite antenna of claim 19, wherein said wave receiving block is formed as a column.

* * * * *